US010119378B2

(12) United States Patent
Lesko et al.

(10) Patent No.: US 10,119,378 B2
(45) Date of Patent: Nov. 6, 2018

(54) WELL OPERATIONS

(71) Applicant: Schlumberger Technology Corporation, Sugar Land, TX (US)

(72) Inventors: Timothy Lesko, Conway, AR (US); Hariharan Ramakrishnan, Sugar Land, TX (US); Dmitriy Potapenko, Sugar Land, TX (US); Leland Ramsey, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 634 days.

(21) Appl. No.: 14/639,770

(22) Filed: Mar. 5, 2015

(65) Prior Publication Data

US 2016/0258264 A1 Sep. 8, 2016

(51) Int. Cl.

| | |
|---|---|
| ***E21B 43/26*** | (2006.01) |
| ***E21B 47/06*** | (2012.01) |
| ***E21B 17/20*** | (2006.01) |
| *E21B 34/00* | (2006.01) |

(52) U.S. Cl.

CPC ..... *E21B 43/26* (2013.01); *E21B 17/20* (2013.01); *E21B 47/06* (2013.01); *E21B 2034/007* (2013.01)

(58) Field of Classification Search

CPC ..... E21B 33/13; E21B 43/25; E21B 43/255; E21B 43/26; E21B 43/261; E21B 43/263; E21B 17/20; E21B 47/06; E21B 2034/007

See application file for complete search history.

(56) References Cited

U.S. PATENT DOCUMENTS

| | | | |
|---|---|---|---|
| 7,021,384 | B2 | 4/2006 | Themig |
| 7,066,265 | B2 | 6/2006 | Surjaatmadja |
| 7,093,664 | B2 | 8/2006 | Todd et al. |
| 7,108,067 | B2 | 9/2006 | Themig et al. |
| 7,134,505 | B2 | 11/2006 | Fehr et al. |
| 7,168,494 | B2 | 1/2007 | Starr et al. |
| 7,210,533 | B2 | 5/2007 | Starr et al. |
| 7,267,172 | B2 | 9/2007 | Hofman |
| 7,322,417 | B2 | 1/2008 | Rytlewski et al. |
| 7,353,878 | B2 | 4/2008 | Themig |
| 7,353,879 | B2 | 4/2008 | Todd et al. |
| 7,377,321 | B2 | 5/2008 | Rytlewski |
| 7,387,165 | B2 | 6/2008 | Lopez De Cardenas et al. |
| 7,431,091 | B2 | 10/2008 | Themig et al. |
| 7,543,634 | B2 | 6/2009 | Fehr et al. |
| 7,681,645 | B2 | 3/2010 | McMillin et al. |
| 2007/0044958 | A1 | 3/2007 | Rytlewski et al. |
| 2007/0107908 | A1 | 5/2007 | Vaidya et al. |
| 2007/0295508 | A1* | 12/2007 | Collins ..... E21B 43/006 166/308.1 |

(Continued)

*Primary Examiner* — Yong-Suk Ro

(74) *Attorney, Agent, or Firm* — Michael L. Flynn; Robin Nava

(57) ABSTRACT

The disclosure pertains to methods for completing a well may comprise lowering a coiled-tubing in the well thus forming an annulus between the casing and the coiled-tubing, pumping down said annulus a treatment fluid above the fracturing pressure of the formation while also pumping fluid through the coiled tubing. The methods may also comprise monitoring in real-time the bottom hole pressure and increasing the pump rate through the coiled-tubing if an increase of bottom hole pressure is observed.

18 Claims, 5 Drawing Sheets

(56) References Cited

U.S. PATENT DOCUMENTS

| | | | |
|---|---|---|---|
| 2008/0135242 | A1 | 6/2008 | Lesko et al. |
| 2009/0084553 | A1 | 4/2009 | Rytlewski et al. |
| 2010/0209288 | A1 | 8/2010 | Marya |
| 2012/0125627 | A1 | 5/2012 | George et al. |

* cited by examiner

WELL OPERATIONS

BACKGROUND

Hydrocarbon fluids such as oil and natural gas are obtained from a subterranean geologic formation, referred to as a reservoir, by drilling a well that penetrates the hydrocarbon-bearing formation. Once a wellbore is drilled, various forms of well completion components may be installed in order to control and enhance the efficiency of producing the various fluids from the reservoir.

Fracturing is used to increase permeability of subterranean formations. A fracturing fluid is injected into the wellbore passing through the subterranean formation. A propping agent (proppant) is injected into the fracture to prevent fracture closing and, thereby, to provide improved extraction of extractive fluids, such as oil, gas or water.

Improvements in completing these unconventional formations would be welcome by the industry.

SUMMARY

In embodiments the disclosure pertains to methods for completing a cased hole wellbore comprising lowering a coiled-tubing in the well thus forming an annulus between the casing and the coiled-tubing, pumping down said annulus a treatment fluid above the fracturing pressure of the formation while also pumping fluid through the coiled tubing; monitoring in real-time the bottom hole pressure, increasing the pump rate through the coiled-tubing if an increase of bottom hole pressure is observed.

In embodiments, the disclosure relates to methods for preventing screenout while hydraulically fracturing a cased hole formation having a coiled-tubing in the casing, the methods comprising pumping down said annulus a treatment fluid above the fracturing pressure of the formation while also pumping fluid through the coiled tubing; monitoring in real-time a bottom hole pressure and increasing the flow rate through the coiled-tubing when an increase of bottom hole pressure is observed.

In embodiments, the disclosure aims at methods for completing at least a zone of a well using a pin-point fracturing technique comprising a cased hole formation having a coiled-tubing in the casing, the methods comprising monitoring a bottom hole pressure in real time and increasing the flow rate through the coiled-tubing when an increase of bottom hole pressure is observed.

In embodiments, the disclosure pertains to methods for completing a well comprising: installing a tubing mounted with sliding sleeve in a drilled well; lowering an actuation device attached to a coiled tubing, thus forming an annulus with the casing; opening a first sleeve; pumping a fracturing fluid down the annulus at or above the fracturing pressure of the formation while simultaneously pumping a neat fluid through the coiled tubing; closing the sleeve; opening a second sleeve and pumping a fracturing fluid at or above the fracturing pressure of the formation; wherein the methods does not involve any sealing element and wherein the methods comprise monitoring a bottom hole pressure in real time and increasing the flow rate through the coiled-tubing when screen out favorable pressure is observed.

In embodiments, the disclosure aims at methods for completing a well, the well having a tubing mounted with sliding sleeves, the methods comprising: lowering a bottom hole assembly (BHA) using a conveyance mean thus forming an annulus between said conveyance mean and the tubing, the BHA comprising a shifting element; opening a sliding sleeve with the shifting element; pumping a fracturing fluid down the annulus, simultaneously pumping a neat fluid through the conveyance mean, calculating in real time the bottom hole pressure, increasing the flow rate in the coiled tubing if an increase of bottom hole pressure is observed while fracturing; further fracturing at least another zone; wherein all steps are done without having the BHA coming out of the well.

BRIEF DESCRIPTION OF THE DRAWINGS

Certain embodiments of the disclosure will hereafter be described with reference to the accompanying drawings, wherein like reference numerals denote like elements. It should be understood, however, that the accompanying drawings illustrate only the various implementations described herein and are not meant to limit the scope of various technologies described herein. The drawings show and describe various embodiments of the current disclosure.

DETAILED DESCRIPTION

Figure 1:
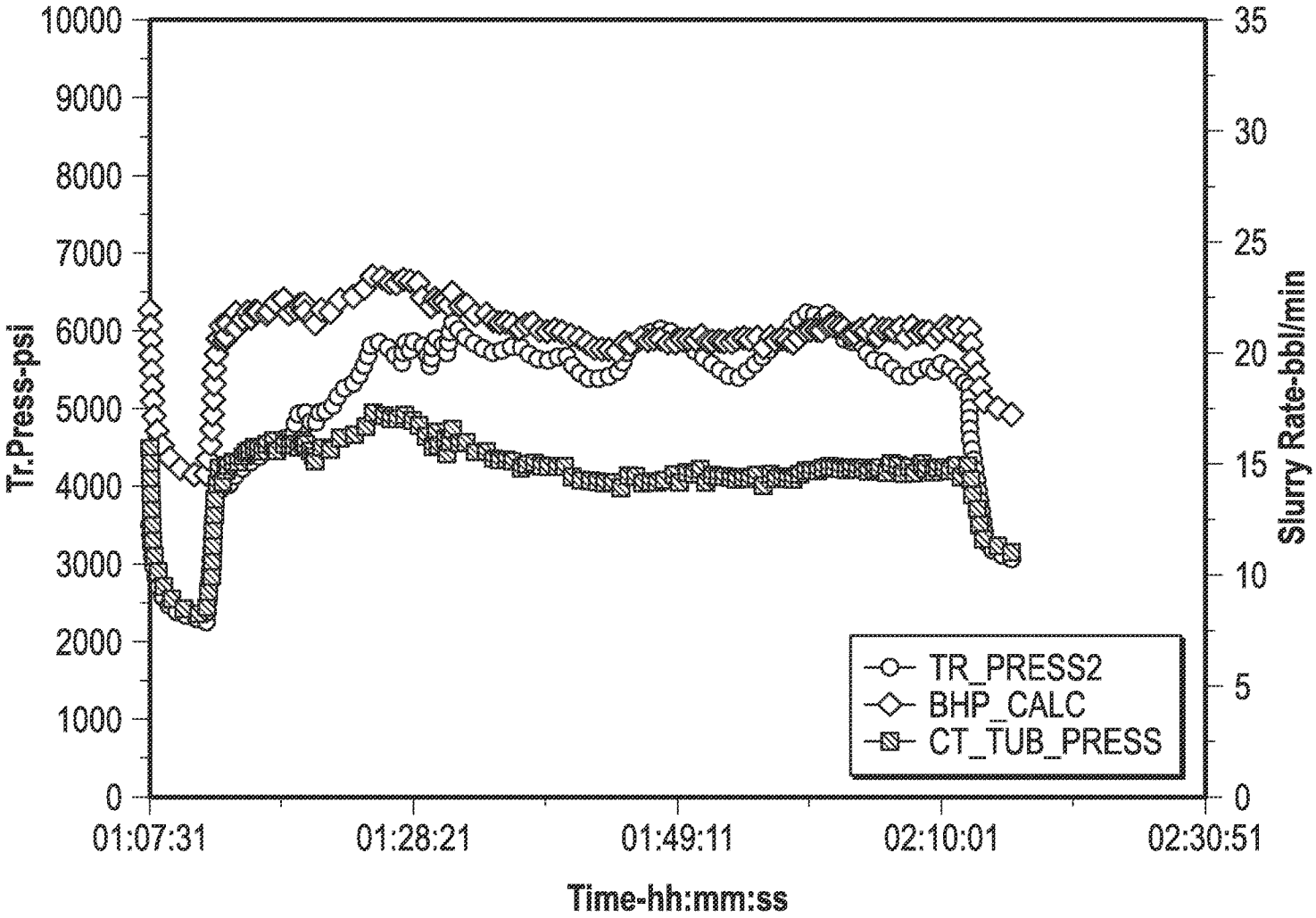
FIG. 1 represents an example where screen out prevention was not necessary during execution of well operations.

At the outset, it should be noted that in the development of any such actual embodiment, numerous implementation—specific decisions must be made to achieve the developer's specific goals, such as compliance with system related and business related constraints, which will vary from one implementation to another. Moreover, it will be appreciated that such a development effort might be complex and time consuming but would nevertheless be a routine undertaking for those of ordinary skill in the art having the benefit of this disclosure. In addition, the composition used/disclosed herein can also comprise some components other than those cited. In the summary and this detailed description, each numerical value should be read once as modified by the term "about" (unless already expressly so modified), and then read again as not so modified unless otherwise indicated in context. Also, in the summary and this detailed description, it should be understood that a concentration range listed or described as being useful, suitable, or the like, is intended that any and every concentration within the range, including the end points, is to be considered as having been stated. For example, "a range of from 1 to 10" is to be read as indicating each and every possible number along the continuum between about 1 and about 10. Thus, even if specific data points within the range, or even no data points within the range, are explicitly identified or refer to only a few specific, it is to be understood that inventors appreciate and understand that any and all data points within the range are to be considered to have been specified, and that inventors possessed knowledge of the entire range and all points within the range.

The statements made herein merely provide information related to the present disclosure and may not constitute prior art, and may describe some embodiments illustrating the disclosure.

In the specification and appended claims: the terms "connect", "connection", "connected", "in connection with", and "connecting" are used to mean "in direct connection with" or "in connection with via one or more elements"; and the term "set" is used to mean "one element" or "more than one element". Further, the terms "couple", "coupling", "coupled", "coupled together", and "coupled with" are used to mean "directly coupled together" or "coupled together via one or more elements". As used herein, the terms "up" and "down", "upper" and "lower", "upwardly" and downwardly", "upstream" and "downstream"; "above" and "below"; and other like terms indicating relative positions above or below a given point or element are used in this description to more clearly describe some embodiments of the disclosure.

The disclosure pertains to methods of treating an underground formation penetrated by either vertical wells or wells having a substantially horizontal section. Horizontal well in the present context may be interpreted as including a substantially horizontal portion, which may be cased or completed open hole, wherein the fracture is transversely or longitudinally oriented and thus generally vertical or sloped with respect to horizontal. The following disclosure will be described using horizontal well but the methodology is equally applicable to vertical wells.

The industry has privileged, when it comes to hydraulic fracturing, what is known as being "plug-and-perf" technique. Horizontal wells may extend hundreds of meters away from the vertical section of the wellbore. Most of the horizontal section of the well passes through the producing formation and are completed in stages. The wellbore begins to deviate from vertical at the kickoff point, the beginning of the horizontal section is the heel and the farthest extremity of the well is the toe. Engineers perform the first perforating operation at the toe, followed by a fracturing treatment. Engineers then place a plug in the well that hydraulically isolates the newly fractured rock from the rest of the well. A section adjacent to the plug undergoes perforation, followed by another fracturing treatment. This sequence is repeated many times until the horizontal section is stimulated from the toe back to the heel. Finally, a milling operation removes the plugs from the well and production commences.

During a conventional hydraulic fracturing treatment, real-time bottom hole pressures are typically not measured and may only be inferred from pressures observed at the surface. Although some data analysis techniques using surface pressures (e.g. Nolte Smith plot) have proven useful for interpreting downhole conditions, these typically are more effective in conventional hydrocarbons bearing reservoirs (e.g. sandstones) and their interpretation and use is not as straightforward in complex, unconventional reservoirs (e.g. shales). In addition, once high pressures or other anomalous situations are noticed, there is typically very little that can be done to immediately change the downhole environment and prevent unwanted conditions such as screenouts.

The industry has tried a few actions to mitigate screenouts. Some operations involved monitoring of the surface pressure and pumping rates response to evaluate if a fracture was initiated or if a screenout may be imminent. If a fracture appeared to be initiated, the operations are performed as planned and the perforating gun is then moved to the next zone. If a screenout condition is present, attempts are made to flush the wellbore. If this proves not to be successful and an upper pressure limit is reached, operations are suspended for a finite period of time to for example let proppant settle-out and then another set of charges is shot at the same zone or close to the same zone. In other attempts, a hydrajet is mounted on the coiled-tubing and the zone is "jetted" which corresponds to perforating at extremely high pressure and flowrate the zone with a fluid containing high amount of sand. Another possibility is to clean the wellbore using a coiled tubing or workover clean out.

These techniques require time and do not allow prevention, they are typically corrective action.

The present disclosure aims at methods for completing a cased well comprising lowering a coiled-tubing in the well thus forming an annulus between the casing and the coiled-tubing, pumping down said annulus a treatment fluid above the fracturing pressure of the formation while also pumping fluid through the coiled tubing; monitoring in real-time the bottom hole pressure, and increasing the pump rate through the coiled-tubing if an increase of bottom hole pressure is observed.

Figure 5:
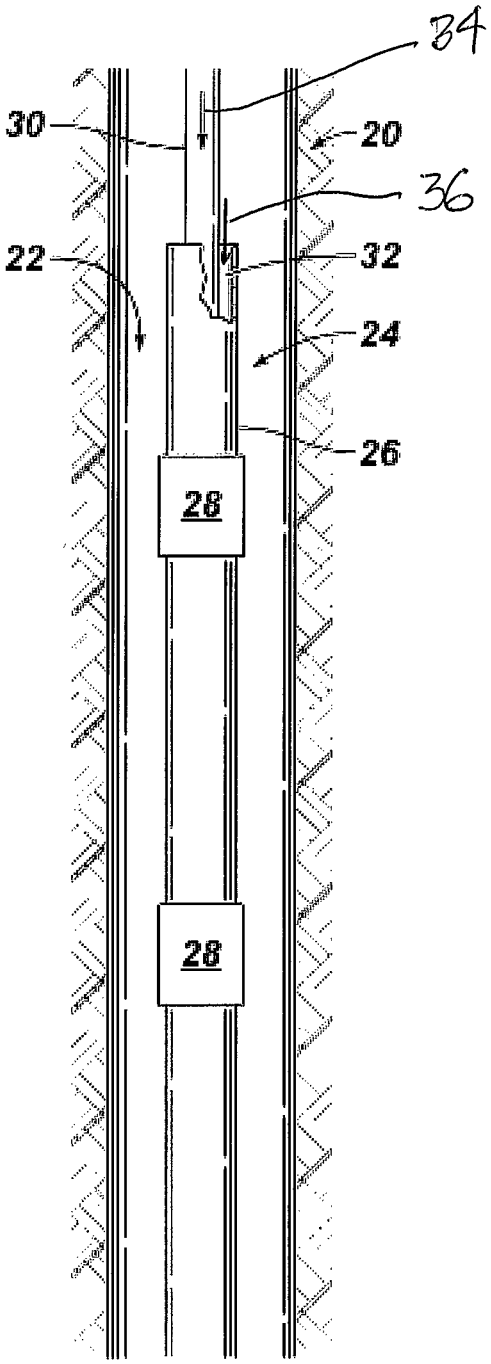
FIG. 5 is a schematic cross sectional view of a coiled tubing, casing, and wellbore according to embodiments of the disclosure.

As shown, schematically in FIG. 5, a well system 20 is illustrated as deployed in a wellbore 22. The well system 20 comprises a tubing string 24 having a tubing or casing 26 extending along and/or within the wellbore 22. In at least some applications, the tubing string 24 is part of a downhole well completion. A plurality of sliding sleeves 28 may be positioned along the tubing string 24. The coiled tubing 30 may be conveyed along an interior of the casing 26 thus forming an annulus 32 between the casing 26 and the coiled tubing 30.

In embodiments the methods might be use in open-hole configurations, in this case, when the coiled tubing is lowered into the wellbore, the annulus is formed between the coiled tubing and the formation per se.

The methods disclosed may be used for preventing screenouts while hydraulically fracturing the formation. Indeed, when the coiled tubing is in the formation, the bottom hole pressure is measured in real time and enables a preventive action such as increasing the flow rate through the coiled-tubing when an increase of bottom hole pressure is observed.

Hydraulic fracturing sometimes referred to as hydraulic stimulation shall be broadly understood as pumping a proppant laden fracturing fluid into a subterranean formation at pressure above a fracturing pressure of the formation.

The term "high pressure pump" as utilized herein should be understood broadly. In certain embodiments, a high pressure pump includes a positive displacement pump that provides an oilfield relevant pumping rate—for example at least 80 L/min (0.5 bbl/min or bpm), although the specific example is not limiting. A high pressure pump includes a pump capable of pumping fluids at an oilfield relevant pressure, including at least 3.5 MPa (500 psi), at least 6.9 MPa (1,000 psi), at least 13.8 MPa (2,000 psi), at least 34.5 MPa (5,000 psi), at least 68.9 MPa (10,000 psi), up to 103.4 MPa (15,000 psi), and/or at even greater pressures. Pumps suitable for oilfield cementing, matrix acidizing, and/or hydraulic fracturing treatments are available as high pressure pumps, although other pumps may be utilized.

A system used to implement the formation treatment may include a pump system comprising one or more pumps to supply the treatment fluid to the wellbore and fracture. In embodiments, the wellbore may include a substantially horizontal portion, which may be cased or completed open hole, wherein the fracture is transversely or longitudinally oriented and thus generally vertical or sloped with respect to horizontal. A mixing station in some embodiments may be provided at the surface to supply a mixture of carrier fluid, proppant, channelant, agglomerant aid, agglomerant aid activator, viscosifier, decrosslinking agent, etc., which may for example be an optionally stabilized concentrated blend slurry (CBS) to allow reliable control of the proppant concentration, any fiber, agglomerant aid, etc., which may for example be a concentrated master batch to allow reliable control of the concentration of the fiber, proppant, agglomerant aid, etc., and any other additives which may be supplied in any order, such as, for example, other viscosifiers, loss control agents, friction reducers, clay stabilizers, biocides, crosslinkers, breakers, breaker aids, corrosion inhibitors, and/or proppant flowback control additives, or the like.

If desired in some embodiments, the pumping schedule for the proppant-laden substages may be employed according to the alternating-proppant loading technology disclosed in U.S. Patent Application Publication No. US 2008/0135242, which is hereby incorporated herein by reference in its entirety.

The term "formation" as utilized herein should be understood broadly. A formation includes any underground fluidly porous formation, and can include without limitation any oil, gas, condensate, mixed hydrocarbons, paraffin, kerogen, water, and/or CO2 accepting or providing formations. A formation can be fluidly coupled to a wellbore, which may be an injector well, a producer well, a monitoring well and/or a fluid storage well. The wellbore may penetrate the formation vertically, horizontally, in a deviated orientation, or combinations of these. The formation may include any geology, including at least a sandstone, limestone, dolomite, shale, tar sand, and/or unconsolidated formation. The wellbore may be an individual wellbore and/or a part of a set of wellbores directionally deviated from a number of close proximity surface wellbores (e.g. off a pad or rig) or single initiating wellbore that divides into multiple wellbores below the surface.

"Treatment fluid" or "fluid" or "fracturing fluid" (in context) refers to the entire treatment fluid, including any proppant, subproppant particles, liquid, etc. "Whole fluid," "total fluid" and "base fluid" are used herein to refer to the fluid phase plus any subproppant particles dispersed therein, but exclusive of proppant particles. "Carrier," "fluid phase" or "liquid phase" refer to the fluid or liquid that is present, which may comprise a continuous phase and optionally one or more discontinuous liquid fluid phases dispersed in the continuous phase, including any solutes, thickeners or colloidal particles only, exclusive of other solid phase particles; reference to "water" in the slurry refers only to water and excludes any gas, liquid or solid particles, solutes, thickeners, colloidal particles, etc.; reference to "aqueous phase" refers to a carrier phase comprised predominantly of water, which may be a continuous or dispersed phase. As used herein the terms "liquid" or "liquid phase" encompasses both liquids per se and supercritical fluids, including any solutes dissolved therein.

In some embodiments, the treatment fluid may be slickwater, or may be brine. In some embodiments, the treatment fluid may comprise a linear gel, e.g., water soluble polymers, such as hydroxyethylcellulose (HEC), guar, copolymers of polyacrylamide and their derivatives, e.g., acrylamidomethyl-propane sulfonate polymer (AMPS), or a viscoelastic surfactant system, e.g., a betaine, or the like. In embodiments the treatment fluid may be an energized fluid, sometimes referred to as foamed fluid; said fluid may be energized for examples with nitrogen, carbon dioxide or hydrocarbons derivatives such as propane or butane.

In some embodiments, the treatment fluid may include a continuous fluid phase, also referred to as an external phase, and a discontinuous phase(s), also referred to as an internal phase(s), which may be a fluid in the case of an emulsion, or which may be a solid in the case of a slurry. The continuous fluid phase, also referred to herein as the carrier fluid or comprising the carrier fluid, may be any matter that is substantially continuous under a given condition. Examples of the continuous fluid phase include, but are not limited to, water, hydrocarbon, etc., which may include solutes, e.g. the fluid phase may be a brine, and/or may include a brine or other solution(s). In the present disclosure, the continuous phase may include a viscosifying and/or yield point agent and/or a portion of the total amount of viscosifying and/or yield point agent present. Some non-limiting examples of the fluid phase(s) include hydratable gels and mixtures of hydratable gels (e.g. gels containing polysaccharides such as guars and their derivatives, xanthan and diutan and their derivatives, hydratable cellulose derivatives such as hydroxyethylcellulose, carboxymethylcellulose and others, polyvinyl alcohol and its derivatives, other hydratable polymers, colloids, etc.), a cross-linked hydratable gel, a viscosified acid (e.g. gel-based), an emulsified acid (e.g. oil outer phase), a viscoelastic surfactant (VES) viscosified fluid, and an oil-based fluid including a gelled, or otherwise viscosified oil.

"Proppant" refers to particulates that are used in well work-overs and treatments, such as hydraulic fracturing operations, to hold fractures open following the treatment. In some embodiments, the proppant may be of a particle size mode or modes in the slurry having a weight average mean particle size greater than or equal to about 100 microns, e.g., 140 mesh particles correspond to a size of 105 microns. In further embodiments, the proppant may comprise particles or aggregates made from particles with size from 0.001 to 1 mm. All individual values from 0.001 to 1 mm are disclosed and included herein. For example, the solid particulate size may be from a lower limit of 0.001, 0.01, 0.1 or 0.9 mm to an upper limit of 0.009, 0.07, 0.5 or 1 mm. Here particle size is defined is the largest dimension of the grain of said particle.

In embodiments, the proppant-containing treatment fluid may comprise from 0.06 or 0.12 g of proppant per mL of treatment fluid (corresponding to 0.5 or 1 ppa) up to 1.2 or 1.8 g/mL (corresponding to 10 or 15 ppa). In some embodiments, the proppant-laden treatment fluid may have a relatively low proppant loading in earlier-injected fracturing fluid and a relatively higher proppant loading in later-injected fracturing fluid, which may correspond to a relatively narrower fracture width adjacent a tip of the fracture and a relatively wider fracture width adjacent the wellbore. For example, the proppant loading may initially begin at 0.48 g/mL (4 ppa) and be ramped up to 0.6 g/mL (6 ppa) at the end.

In embodiments, the treatment fluid further comprises fibers. The fibers maybe silicone modified or not depending on the treatment fluid used. In embodiments, the fibers is selected from the group consisting of polylactic acid (PLA), polyglycolic acid (PGA), polyethylene terephthalate (PET), polyester, polyamide, polycaprolactam and polylactone, poly(butylene) succinate, polydioxanone, nylon, glass, ceramics, carbon (including carbon-based compounds), elements in metallic form, metal alloys, wool, basalt, acrylic, polyethylene, polypropylene, novoloid resin, polyphenylene sulfide, polyvinyl chloride, polyvinylidene chloride, polyurethane, polyvinyl alcohol, polybenzimidazole, polyhydroquinone-diimidazopyridine, poly(p-phenylene-2,6-benzobisoxazole), rayon, cotton, cellulose and other natural fibers, rubber, and combinations thereof. In embodiments, the fibers comprise a polyester and silicones and may be in the form of a dual component such as a shell and a core or a composite. In this configuration the fibers may contain 0.1 to 20 wt % of silicones.

In embodiments, the disclosure pertains to operations including lowering a coiled tubing string with a Bottom Hole Assembly (BHA) including sensors, means to transmit information, such as bottom hole pressure, in real time to a surface acquisition system.

By using coiled tubing in conjunction with conventional hydraulic fracturing equipment, it is possible to engineer a system whereby there is both a "monitoring tool" for downhole conditions, and also a "prevention tool" to change the downhole conditions and limit or prevent the occurrence of unwanted events during a hydraulic fracturing treatment, including screenouts.

In embodiments, fluid is pumped at a minimal rate through the coiled tubing string in a direction indicated by an arrow 34 (see FIG. 5), while the main high-rate (e.g. 10-40 bpm) hydraulic fracturing treatment is pumped down the annulus in a direction indicated by an arrow 36 (see FIG. 5) by the high pressure pumps. The treatment fluid pumped down the annulus will typically also convey the sand/proppant or any other solids (e.g. fibers, solid additives) as mentioned earlier, whereas the fluid pumped through the coiled tubing will typically only contain neat fluid. This neat fluid may be water, or water with various chemicals including but not limited to friction reducers or gelling agents (guar). However, since the fluid pumped down the coil may not contain sand or cross-linked fluids, the pressure behavior within the coiled tubing will be more consistent during the job and therefore providing a meaningful estimate of the bottom hole pressure.

This estimate of the bottom hole pressure can be displayed real-time to the various supervisors or engineers viewing the stimulation treatment. When the bottom-hole pressure is increasing in a manner which is indicative of an imminent issue within the fracture (e.g. onset of a screenout), the rate in the coil tubing can be incrementally increased. Having the coiled tubing already in place enables the operator to act independently of the rate of the fluid pumped down the annulus (e.g. the treatment fluid pumped through the annulus may be maintained at the set rate, or changed if desired). An increase of pressure indicative of an imminent screenout might be for example a sustained bottomhole pressure increase of from about 200 psi/min for 1-2 minutes or more. Accordingly, when such conditions are present the flow rate from the coiled tubing may be increase from 0.5 bpm to about 1 bpm, i.e. at least doubled. Should the bottomhole pressure continue to increase, the flow rate through the coil will be further increase to, for example, triple or more the initial coiled tubing flow rate, such flow rate may be as high as 3 bpm, or 4 bpm or even 6 bpm. The inventors have determined that increasing the flow rate down the coiled tubing alleviates downhole pressure conditions and causes a reduction in the overall downhole treating pressures. This technique allows operators to more accurately predict the downhole conditions during a hydraulic fracturing treatment, reduce the treating pressures (both at the surface and downhole), and allow for more effective placement of proppant within the fracture, while preventing screenouts.

In some embodiments, the methods may comprise injecting a pre-pad, pad, tail or flush stage or a combination thereof.

The disclosure referred to as using the coiled tubing to predict the downhole pressure The bottom hole pressure may be calculated using the following equation:

-

Where $P_{Coil\ at\ Surface}$ is the pressure measured at the entrance of the coiled tubing reel, $P_{Hydrostatic}$ is the pressure induced by the column of fluid in the wellbore (measured with respect to the true vertical depth (TVD), and $P_{Coil\ Friction}$ is the additional pressure that results from the fluid being pumped through a certain length of pipe, irrespective of the elevation changes of the fluid.

In embodiments, the disclosure aims at methods for completing at least a zone of a well using a pin-point fracturing technique comprising a cased hole formation having a coiled-tubing in the casing, the methods comprising monitoring a bottom hole pressure in real time and increasing the flow rate through the coiled-tubing when an increase of bottom hole pressure is observed.

The common practice in the art is to perforate 4-6 clusters, and push a slickwater laden fluid at or above fracture pressure to create fractures; it is estimated that 30 to 60% of these perforations do not produce due to for example screen out, geological constraint, etc., and thus for every 100 perforations in a wellbore, commonly only 30 to 70 of the conventional perforations are useful for production.

To respond to that, some operations now involve what is known as pin-point fracturing, which may be defined as the operation of pumping a fluid above the fracturing pressure of the formation to be treated through a single entry. The entry may be a perforation, a valve, a sleeve, or a sliding sleeve. Generally, sliding sleeves in the closed position are fitted to the production liner. The production liner is placed in a hydrocarbon formation. An object is introduced into the wellbore from surface, and the object is transported to the target zone by the flow field or mechanically, for example using a wireline or a coiled tubing. When at the target location, the object is caught by the sliding sleeve and shifts the sleeve to the open position; alternatively the object is catching the sleeve and opens it. A sealing device, such as a packer or cups, is positioned below the sleeve to be treated in order to isolate the lower portion of the wellbore. The sealing device is set, fluid is pumped into the fracture and then the sealing device is unset and moved below the next zone (or sleeve) to be treated. Representative examples of sleeve-based systems are disclosed in U.S. Pat. Nos. 7,387,165, 7,322,417, 7,377,321, US 2007/0107908, US 2007/0044958, US 2010/0209288, U.S. Pat. No. 7,387,165, US2009/0084553, U.S. Pat. Nos. 7,108,067, 7,431,091, 7,543,634, 7,134,505, 7,021,384, 7,353,878, 7,267,172, 7,681,645, 7,066,265, 7,168,494, 7,353,879, 7,093,664, and 7,210,533, which are hereby incorporated herein by reference. A fracturing treatment is then circulated down the wellbore to the formation adjacent the open sleeve.

While the current methods may be used in pin-point fracturing operations involving isolating (e.g. with a packer) each zone before the stimulating treatment; in embodiments herein methods of completing an underground formation using multi-stage pin-point fracturing for treating a well without using any sealing element are also encompassed.

In embodiments, a cased-hole is provided with a production tubing (or casing) fitted with sliding reclosable sleeves in the desired quantity and at the desired location. After the completion equipment (desired amount of sleeves and casing) is installed into the well, the well would be set up for fracture/stimulation operations. Using, for example, a coil tubing or stick pipe, an actuation device would be conveyed into the well.

The actuation device, indifferently mentioned here as shifting tool, may be a tool that is equipped with a sleeve engaging member selectively extendable from the shifting tool in parallel to a central axis of the shifting tool and engageable upon the sleeve wherein the shifting tool is moveable so as to cause the sleeve to selectively cover and uncover the apertures. A suitable combination sliding sleeve and shifting tool may be found in US201210125627 incorporated herein by reference in its entirety.

In embodiments, the method for completing a well involves an apparatus for selectively opening a valve body in a well casing having a central passage and a plurality of apertures therethrough. The apparatus comprises a sleeve slidably located within the central passage of the valve body adapted to selectively cover or uncover the apertures and a shifting tool slidably locatable within the sleeve. The apparatus further comprises at least one sleeve engaging member selectively extendable from the shifting tool in parallel to a central axis of the shifting tool and engageable upon the sleeve wherein the shifting tool is moveable so as to cause the sleeve to selectively cover and uncover the apertures.

In embodiments, hydraulic fracturing operations could start at any location in the well; for example from toe-to-heel, or from heel-to-toe or at any preferred location by opening the sleeve corresponding to the chosen zone to be fracture; then, the fracturing fluid is pumped in the annulus and pressure may be increased until reaching the fracturing pressure of the formation. The created fracture may then be propped with the fracturing fluid and when the operator decides to move to another zone, the activation device will then be used to reclose the opened sleeve, thus isolating the treated zone. Operations may be continued by opening another sleeve with the shifting tool and repeating the fracturing operationd and reclosing the sleeve.

The coiled tubing, is in this case used as a conveyance mean but as mentioned before also as the screenout prevention tool since a fluid is pumped through it during all operations. Since the coiled-tubing is present to support the shifting tool, its flowrate may be adapted at any time in order to prevent a potential screen out during operations.

Each zone may be fractured independently and then isolated after the fracture is complete. The reclosing sleeve enables to fracture and isolate each specific zone without using any isolation (or sealing) elements such as packer, isolation plug, or cups. In embodiments, the tool string (also referred to as conveyance mean) may also be combined with a cleaning equipment (such as a motor and mill); this would improve pin-point fracturing efficiency and reliability since it avoids running a cleaning stage before initiating any fracturing operations.

In embodiment, the actuation device is mounted on the coiled tubing element. The coiled tubing remains in the wellbore during the fracture/stimulation. Once all the zones are fractured/stimulated the coiled tubing may be lowered to the toe of the well. During this time, the clean out of the well can be performed without having to change any part of the Bottom Hole Assembly (BHA) to ensure all debris and sand are washed from the wellbore.

Once the cleanout is completed, the actuation device is put in opening position and the coil tubing is pulled out of the well. The upward motion would open all the sleeves coming out of the well leaving the well clean and ready for production.

While the present disclosure has been disclosed with respect to a limited number of embodiments, those skilled in the art, having the benefit of this disclosure, will appreciate numerous modifications and variations there from. It is intended that the appended claims cover such modifications and variations as fall within the true spirit and scope of the disclosure.

EXAMPLES

Example 1

Prediction of Bottomhole Pressure

A hydraulic fracturing treatment was pumped on a well with a true vertical depth of 5,000 feet. A crosslinked fluid containing sand was pumped with high pressure pumps down the annulus. The coiled tubing unit was pumping fresh water containing 0.5 gpt of a friction reducer at 0.5 barrels per min (bpm). The pressure at the pumps was 5,200 psi. The pressure at the entrance of the coil tubing reel was 3,000 psi.

The hydrostatic pressure was calculated using

Where the SG is the specific gravity of the fluid. In this case, since the fluid in the coil was water, the SG is 1. Therefore in this example the $P_{Hydrostatic}$=2,165 psi.

Figure 4:
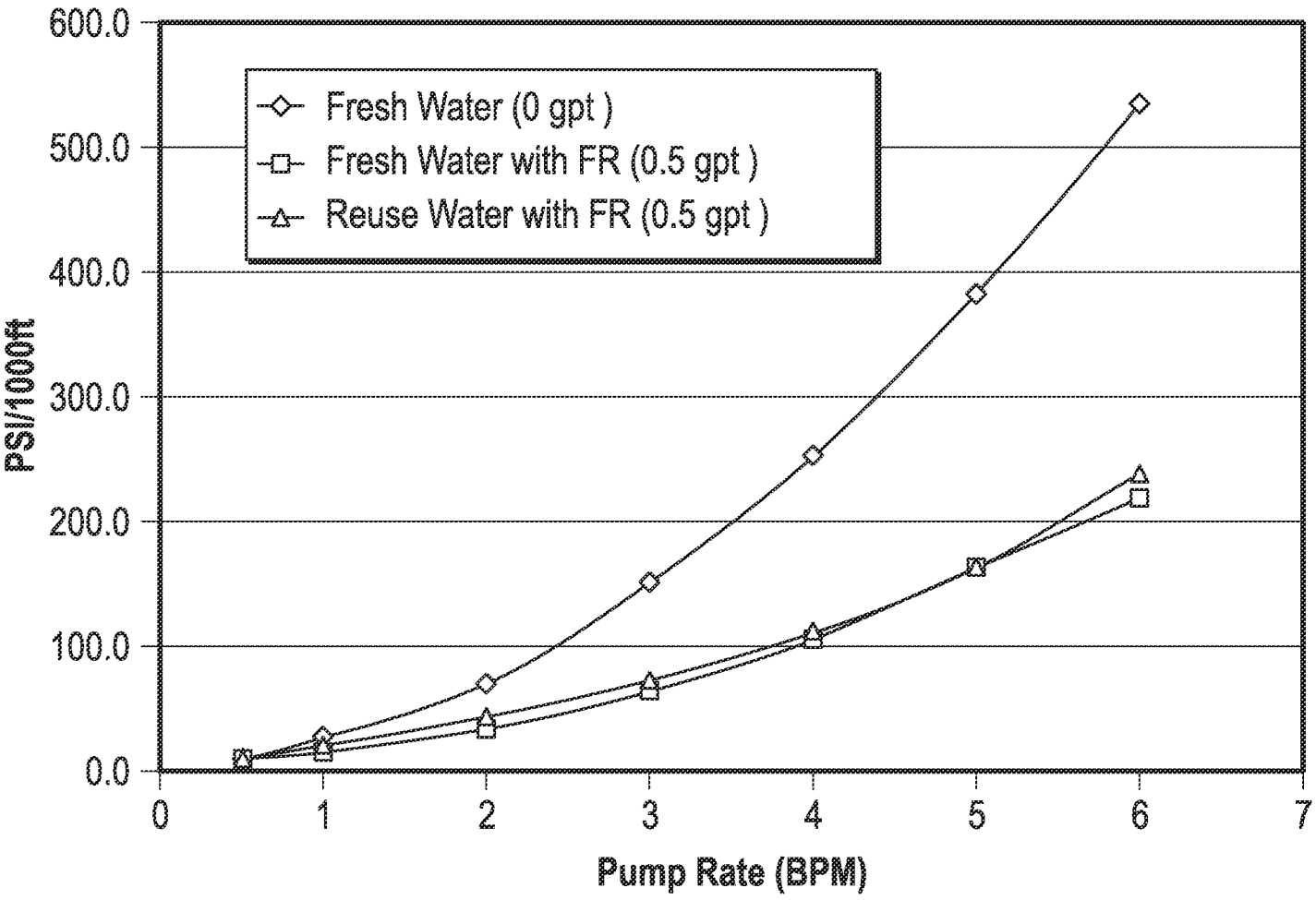
FIG. 4 represents curves used in the calculation of bottom hole pressure.

By using values from previously executed calibrations tests (FIG. 4), one can correct for pressures caused by friction. In this case, at 0.5 bpm one can expect approximately 10 psi increase for each 1,000 feet. Given that the coil reel was 13,000 feet long, the total pressure from friction was expected to be 10×13=130 psi=$P_{Coil\ Friction}$.

Accordingly: =3,000 psi+2,165 psi−130 psi=5,035 psi.

Example 2

Operations without Flow Rate Increase

Figure 2:
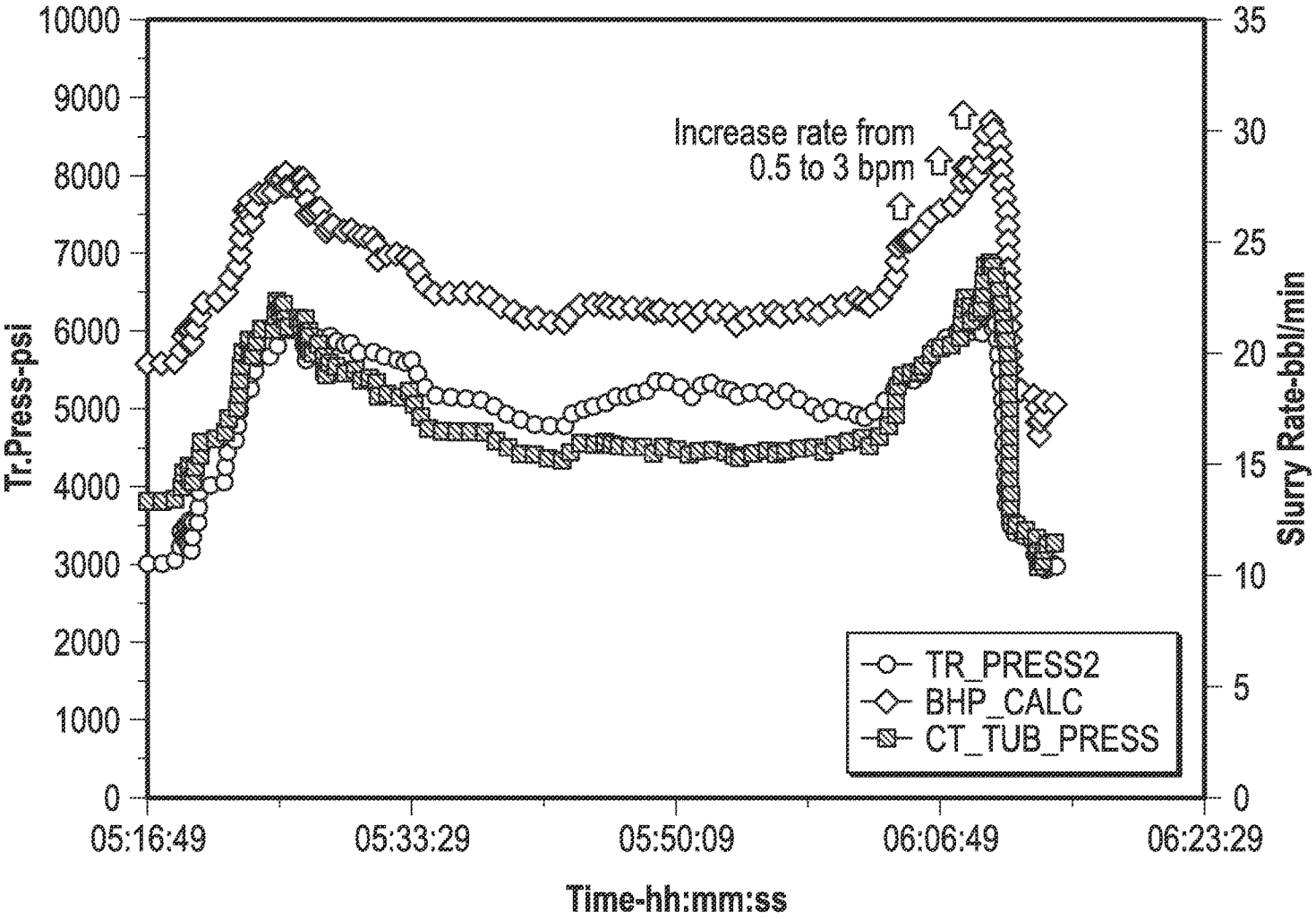
FIG. 2 an example of screen out prevention according to the disclosure.

FIG. 1 illustrates how a coiled tubing string was used for evaluating downhole pressure behavior, and FIG. 2 illustrates how this information was used and the coiled tubing itself was used as a tool to ultimately correct the conditions allowing the hydraulic fracturing treatment to be pumped to completion without screening out a zone. During treatment the coiled tubing rate was initially held steady at 0.5 bpm pumping fresh water. The pressure recorded at the coil entrance is shown as "CT_TUB_PRESS". The bottom hole pressure was calculated. This calculated value is shown as "BHP_CALC"; however, it should be pointed out that this particular calculation neglected friction pressures in the calculation. Therefore, the two pressure curves always track with each other, with only a simple offset due to hydrostatic pressure (which is constant since the depth of the coil tubing didn't vary in the middle of the treatment).

The fracturing fluid (containing cross-linked fluids, proppants, fibers and other solids) was pumped down the annulus. This is seen in FIG. 1 as TR-PRESS2. As apparent, the pressure measured from the coiled tubing did not follow the same profile as the fracturing treating pressure. During stage 20 (FIG. 1) At 01:50 and later at 02:00 the surface pressure experienced two increases and subsequent decreases of over 750 psi surface treating pressure. During these times the pressure recorded at the coil tubing were relatively flat and therefore this was likely an indication that there were no significant issues downhole near the entrance to the formation. Accordingly, this operation was pumped to completion, per design, with no additional rate adjustments made to the coiled tubing pump rate.

Example 3

Operation where Screen Out Prevention was Required

As with the previous example from stage 20, during the middle of stage 50 at 05:51, the surface treating pressure from the fracturing equipment showed a considerable increase of over 500 psi; however, the coiled tubing pressure remained relatively flat, indicating that the pressure at surface was likely caused by chemical changes in the fluid pumped down the annulus. No changes were made to coil tubing pump rates at this time. When the coil tubing pressures began to rise at approximately 06:00, this was an indication that conditions were now changing downhole and the formation was likely to begin to become harder to stimulate i.e. was about to screenout.

Rates in the coil tubing were incrementally increased from 0.5 bpm up to 3.0 bpm (indicated by the upward arrows). The fracturing treatment rates down the annulus were not changed and remained at 25 bpm. This resulted in a small increase in the total downhole fluid rate from 25.5 bpm to 28 bpm. However, this increase in rate ultimately led to breakovers in the pressure that indicated the formation was becoming more receptive to the fracturing treatment. In this case, the well did not screenout.

Example 4

Operation where Screen Out Prevention was Required

Figure 3:
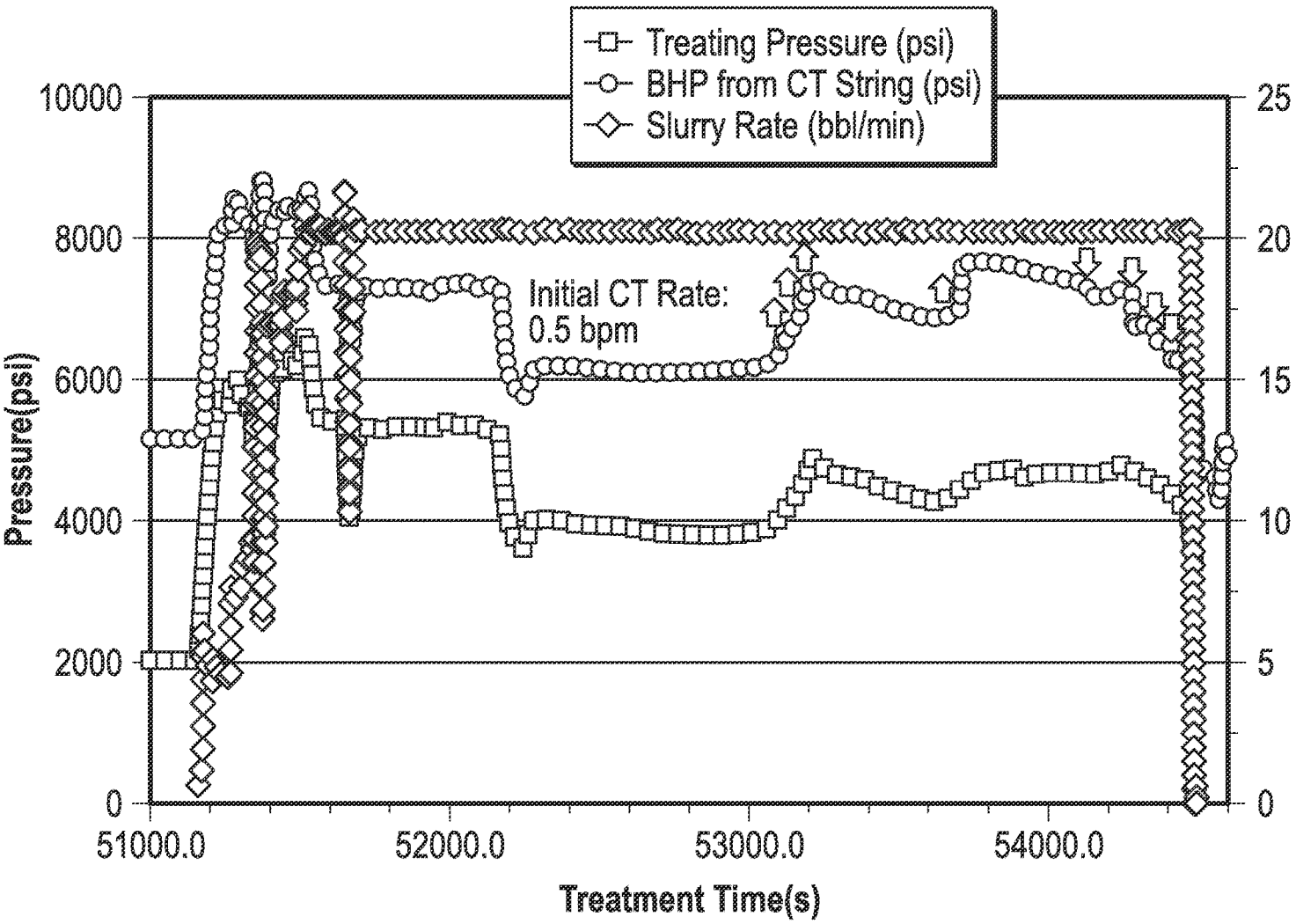
FIG. 3 represents another example of screen out prevention according to the disclosure.

FIG. 3 illustrates how the coiled tubing string was used for both predicting screenout behavior, and ultimately correcting the conditions allowing the hydraulic fracturing treatment to be pumped to completion without screening out the zone.

As with the previous two examples, during the treatment the coiled tubing rate was initially held steady at 0.5 bpm pumping fresh water. The bottom hole pressure was calculated from the coiled tubing reel pressure and shown in FIG. 3 as "BHP from CT string (psi)." The surface pressure from the fracturing equipment (pumping fluid on the outside of the coil string, down the annulus) is shown as "Treating Pressure (psi)."

During the middle of the treatment (i.e. 52500 sec), both the coiled tubing and the fracturing surface pressures were relatively flat. However, at approximately 53,000 seconds the pressures began to increase on both gauges. Because the pressure was increasing on the coil, this was likely not simply a fracturing chemistry change, but a real indication of changes in fracturing behavior within the formation. Rates were incrementally increased from 0.5 bpm to 4 bpm (indicated by the 3 arrows). This initially caused a pressure increase, but eventually caused a breakover in pressure seen at 53,200 sec. This trend continued for approximately 500 sec (~8 min); however, the pressures eventually plateau and then began to increase again.

The pump rate down the coiled tubing was increased one final time to 6 bpm and this caused both a decrease in the coiled tubing downhole pressure and a leveling of the surface pressure on the fracturing equipment. This indicated that the formation was becoming more receptive to the fracturing treatment. Coiled tubing rates were then incrementally decreased to a final value of 0.5 bpm, indicated by the downward pointing arrows. In this case, the well did not screenout.

What is claimed is:

1. A method for treating a cased hole wellbore comprising:

Lowering down a coiled tubing in the casing, thus forming an annulus between the casing and the coiled-tubing;

Pumping a fracturing fluid through said annulus;

Simultaneously pumping a fluid through the coiled tubing at a determined flow rate tubing while pumping the fracturing fluid down the annulus;

Monitoring a bottom hole pressure;

Wherein in case of an increase of bottomhole pressure corresponding to a potential screenout, the flow rate of the fluid pumped through the coiled tubing is increased.

2. The method of claim 1, wherein the determined flow rate in the coiled tubing is from about 0.3 to about 0.8 bbl/min.

3. The method of claim 1, wherein flow rate through coiled tubing after increase is from about 3 to about 6 bbl/min.

4. The method of claim 1, wherein the increase of bottom hole pressure is at least of about 100 psi.

5. The method of claim 1 wherein the fluid pumped through coiled tubing is a neat fluid.

6. The method of claim 1 wherein the fluid pumped through coiled tubing is a Newtonian fluid.

7. A method for preventing screenout in a wellbore being hydraulically fractured, the wellbore comprising a casing and a coiled tubing within the casing thus forming an annulus; the method comprising Monitoring bottomhole pressure in the wellbore;

Pumping through the annulus a fluid above the fracturing pressure of the wellbore;

Simultaneously pumping a fluid through the coiled tubing at a determined flow rate tubing while pumping the fluid through the annulus;

Increasing the flow rate through the coiled tubing when an increase of bottomhole pressure is observed.

8. The method of claim 7, wherein the determined flow rate in the coiled tubing is from about 0.3 to about 0.8 bbl/min.

9. The method of claim 7, wherein flow rate through coiled tubing after increase is from about 3 to about 6 bbl/min.

10. A method for completing at least a zone of a well using a pin-point fracturing technique comprising a cased hole formation having a coiled-tubing disposed in the casing, the methods comprising simultaneously flowing fluid through the coiled-tubing and an annulus formed between the coiled tubing and the casing, monitoring a bottom hole pressure in real time, and increasing the flow rate through the coiled-tubing when an increase of bottom hole pressure is observed.

11. The method of claim 10 wherein the casing comprises a plurality of reclosable sleeves at desired locations and the wellbore is cemented.

12. The method of claim 11 further comprising conveying an actuation device to one of the plurality of reclosable sleeves, actuating the device to open a sleeve and performing the fracturing operation.

13. The method of claim 12 further comprising closing the sleeve, conveying the actuation device to another of the plurality of reclosable sleeves, actuating the device to open another sleeve, and performing a further fracturing operation.

14. The method of claim 12, wherein the other sleeve is downhole from the one of the plurality of reclosable sleeves.

15. The method of claim 12, wherein the other sleeve is uphole from the one of the plurality of reclosable sleeves.

16. A method for completing a well comprising:

(i) Installing a tubing mounted with sliding sleeve in a drilled well;

(ii) Lowering an actuation device attached to a coiled tubing, thus forming an annulus with a casing in the well;

(iii) Opening a sleeve;

(iv) Pumping a fracturing fluid down the annulus at or above a fracturing pressure of a well formation while simultaneously pumping a neat fluid through the coiled tubing;

(v) Closing the sleeve;

(vi) Repeating steps (iii) to (v);

Wherein the method comprises monitoring a bottom hole pressure in real time and increasing the flow rate through the coiled-tubing when screen out favorable pressure is observed.

17. The method of claim 16, wherein no sealing element is used.

18. A method for completing a well, the well having a tubing mounted with sliding sleeves, comprising:

Lowering a bottom hole assembly (BHA) using a coiled tubing thus forming an annulus between said coiled tubing and the tubing, the BHA comprising a shifting element;

Opening a sliding sleeve with the shifting element;

Pumping a fracturing fluid down the annulus,

Simultaneously pumping a neat fluid through the coiled tubing while pumping the fracturing fluid down the annulus, Calculating in real time a bottom hole pressure, Increasing the flow rate in the coiled tubing when an increase of bottom hole pressure is observed while fracturing;

Further fracturing at least another zone;

Wherein all steps are done without having the BHA coming out of the well.

* * * * *